US005336145A

United States Patent [19]

Keiser

[11] Patent Number: 5,336,145

[45] Date of Patent: Aug. 9, 1994

[54] APPARATUS HAVING A MOVABLE LOAD BEARING SURFACE

[76] Inventor: Dennis L. Keiser, 10779 E. Ashlan, Sanger, Calif. 93657

[21] Appl. No.: 160,437

[22] Filed: Dec. 1, 1993

Related U.S. Application Data

[63] Continuation of Ser. No. 36,976, Mar. 25, 1993, abandoned, which is a continuation of Ser. No. 753,424, Aug. 30, 1991, abandoned.

[51] Int. Cl.[5] ..... A63B 22/02

[52] U.S. Cl. ..... 482/54; 482/51

[58] Field of Search ..... 482/54, 51, 52; 198/847

[56] References Cited

U.S. PATENT DOCUMENTS

| | | |
|---|---|---|
| 3,608,898 | 9/1971 | Berlin . |
| 3,711,090 | 1/1973 | Fiedler . |
| 4,334,676 | 6/1982 | Schonenberger . |
| 4,548,405 | 10/1985 | Lee et al. . |
| 4,614,336 | 9/1986 | Taitel . |
| 4,614,337 | 9/1986 | Schonenberger . |
| 4,664,371 | 5/1987 | Viander . |
| 4,776,581 | 10/1988 | Shepherdson . |

OTHER PUBLICATIONS

Westmont Industries brochure, Sweet's #39417, 14 pages, "Moving Stairs & Walks Passenger Conveying Systems".

Copy of brochure entitled "WOODWAY Slat Belt Transportation System versus Conventional Treadmill Conveyor Belts" 6 pages.

Copy of brochure entitled "The world's finest treadmill is now made right here in America" 1 page.

*Primary Examiner*—Richard J. Apley
*Assistant Examiner*—Lynne A. Reichard
*Attorney, Agent, or Firm*—Worrel & Worrel

[57] ABSTRACT

An apparatus having a movable load bearing surface, the apparatus having a frame having a pair of laterally spaced conveying assemblies generally extending along a course of movement; a conveying member defining the load bearing surface supported on said conveying assemblies for movement substantially along said course of movement; a multiplicity of structural elements mounted on the conveying assemblies to impart support to the load bearing surface; and a drive system connected in driving relation to the conveying member operable to drive said conveying member over the conveying assemblies in said course of movement.

6 Claims, 6 Drawing Sheets

10
11
20
21
22
23
24
40
41
42
43
45
60
63
64
67
80
81
82
84
85
86
90
91
107
117
130
132
165
166
167
168
225
226
227
230
231
232
233
234
235
240
241
242
243
244
245

APPARATUS HAVING A MOVABLE LOAD BEARING SURFACE

This is a continuation of copending/application(s) Ser. No. 08,036,976 filed on Mar. 25, 1993 now abandoned which is a continuation of Ser. No. 07/753,424 filed Aug. 30, 1991 now abandon.

BACKGROUND OF THE INVENTION

1. Field of the Invention:

The present invention relates to an apparatus having a movable load beating surface and, more particularly, to such an apparatus which, in its preferred embodiment, can be employed as a treadmill-type exercising apparatus achieving operative advantages not heretofore achieved in the art.

2. Description of the Prior Art:

Movable load bearing surfaces are employed in a variety of operative environments in the transport of a wide variety of types of work objects. Depending upon the objectives and demands of the particular operative environment, the criteria to be employed in evaluating the success of such operation may vary.

For example, in the exercise equipment industry the use of treadmill-type exercising machines has been known for a significant period of time. Such exercising machines typically consist of a flexible rubberized, or synthetic plastic belt which is traveled about a pair of spaced cylindrical pulleys. The upper run of the belt is traveled over a rigid bed extending substantially over the entire underside of the upper run of the belt and reinforced for the purpose of supporting the belt during use. As the upper run of the belt is traveled over the bed of the treadmill-type exercising device, the user walks or runs in place at a velocity sufficient to remain substantially in place on the upper run of the belt. The velocity of the belt is, accordingly, adjusted to suit the desired velocity of the person. Because of the inherent flexibility of the belt material, the bed is required to support the upper run of the belt against the weight and downward pressure applied by the user in walking or running. Were it not for the bed, the belt would simply collapse under the weight and downward force applied by the user.

Such construction, in conventional treadmill-type exercising devices, presents a myriad of operative disadvantages which substantially detract from the operability thereof. Rested engagement of the under surface of the upper run of the belt on the bed produces a substantial friction resisting movement of the belt over the bed. Thus, a more powerful drive system is required than would otherwise be the case. Similarly, the friction produced by movement of the belt over the bed causes substantial wearing of the belt requiting that it frequently be replaced or repaired. For the same reason, the other operative elements of such conventional exercising devices, and particularly those in the drive train, require frequent replacement and repair because of the substantial load placed on them by means of the drag encountered in the movement of the belt over the bed. These problems are aggravated by the fact that the belt supports the weight of a person exercising on the exercising device as well as receiving the additional force applied thereto in the walking or running movement of the user.

Still further, the rigidity of the bed of the treadmill-type exercising device affords little or no cushioning to the body of the person exercising thereon. Thus, the force applied to the upper run of the belt and thereby to the bed by the user during walking or running is transferred back through the feet of the user into the body causing trauma, particularly to joints, muscles and organs of the body. Over time, such trauma can produced chronic soreness, injury or other discomfort which detracts from the desirability of using the exercising device. All such prior art treadmill-type exercising devices of which the applicant is aware have possessed this structure and accordingly suffered from the foregoing operative disadvantages.

Therefore, it is an object of the present invention to provide an improved apparatus having a movable load bearing surface which has particular utility in use as a treadmill-type exercising apparatus and wherein the belt employed thereon can be rotated in its normal path of movement with minimum wearing or damage to the belt itself, the supporting structure therefor, the drive train operable to drive the belt, and the other operative components of the exercising apparatus all in an apparatus which imparts a cushioning effect ensuring that discomfort, trauma and injury are reduce to a minimum not heretofore achieved in the art.

SUMMARY OF THE INVENTION

Therefore, it is an object of the present invention to provide an improved apparatus having a movable load bearing surface.

Another object is to provide such an apparatus which has particular utility when employed as a treadmill-type exercising apparatus operable to reduce to a minimum the wearing and damage to the operative components thereof to an extent not heretofore achieved in the art.

Another object is to provide such an apparatus which reduces to an absolute minimum the friction created in transporting the belt thereof along its path of travel during use.

Another object is to provide such an apparatus in which the upper run of the belt is not supported by an underlying bed and thereby friction produced in the transport of the upper run of the belt in normal operation is reduced to an absolute minimum.

Another object is to provide such an apparatus which affords a cushioning effect to the user during operation thereof to such an extent as to reduce to an absolute minimum the discomfort, trauma and injury heretofore associated with the use of conventional treadmill-type exercising devices.

Another object is to provide such an apparatus which is fully compatible with conventional exercise, therapeutic and training techniques employed in the operation of treadmill-type exercising devices.

Another object is to provide such an apparatus which can be employed to vary the angle of incidence at which walking, running or other exercising regimens can be employed.

Another object is to provide such an apparatus which requires significantly less power to transport the belt in its course of travel than has heretofore been possible in the art.

Further objects and advantages are to provide improved elements and arrangements thereof in an apparatus for the purpose described which is dependable, economical, durable and fully effective in accomplishing its intended purpose.

These and other objects and advantages are achieved, in the preferred embodiment of the apparatus of the present invention, by a frame having a pair of laterally spaced conveying assemblies generally extending along a course of movement; a conveying member defining the load bearing surface supported on the conveying assemblies for movement substantially along the course of movement; a multiplicity of structural elements mounted on the conveying member and extending substantially transversely to the course of movement and over the conveying assemblies to impart support to the load bearing surface; and a mechanism for driving the conveying member over the conveying assemblies in the course of movement.

DESCRIPTION OF THE PREFERRED EMBODIMENT FIRST EMBODIMENT

Figure 1:
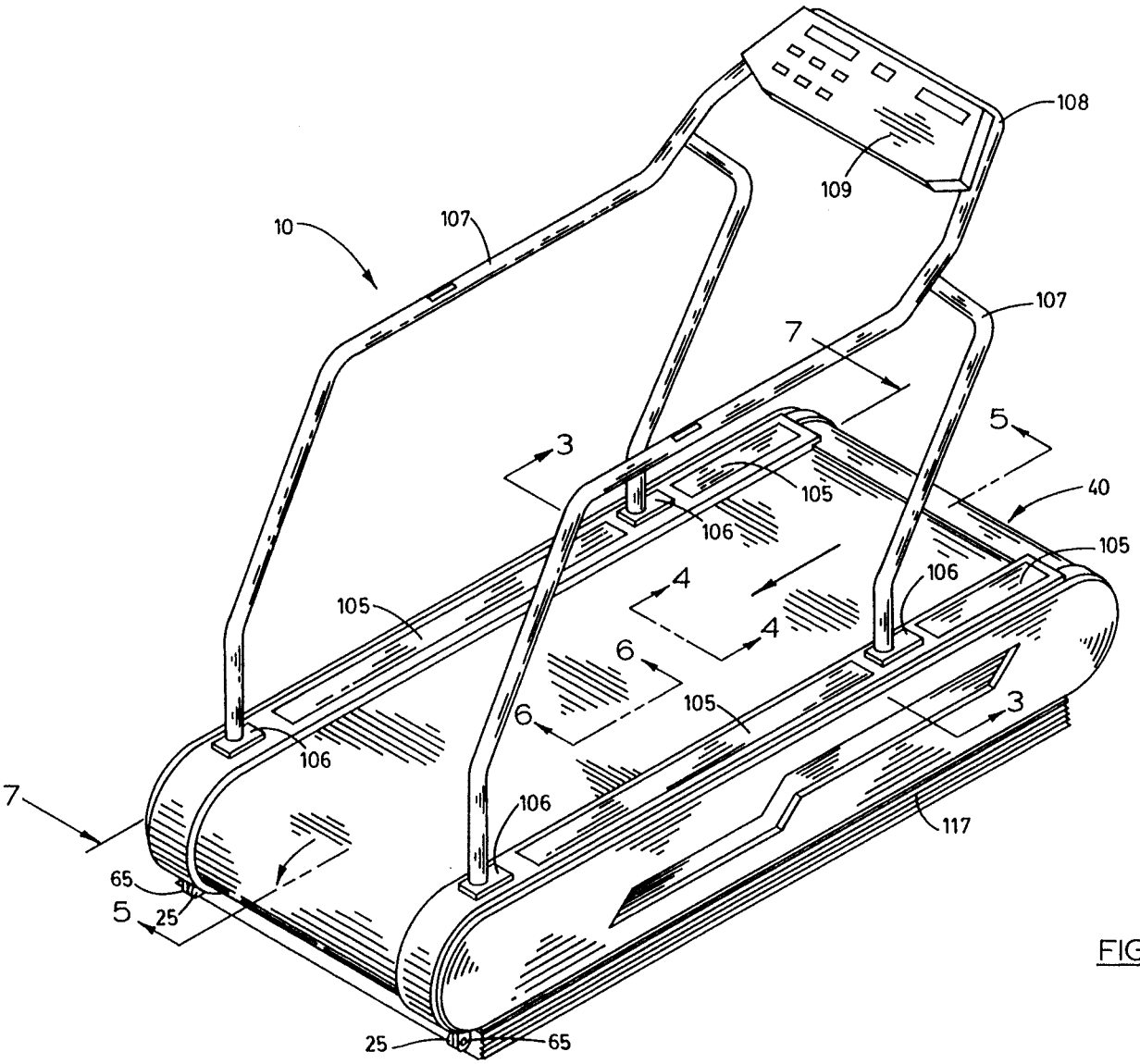
FIG. 1 is a perspective view of the first embodiment of the apparatus having a moveable load bearing surface of the present invention.
Figure 2:
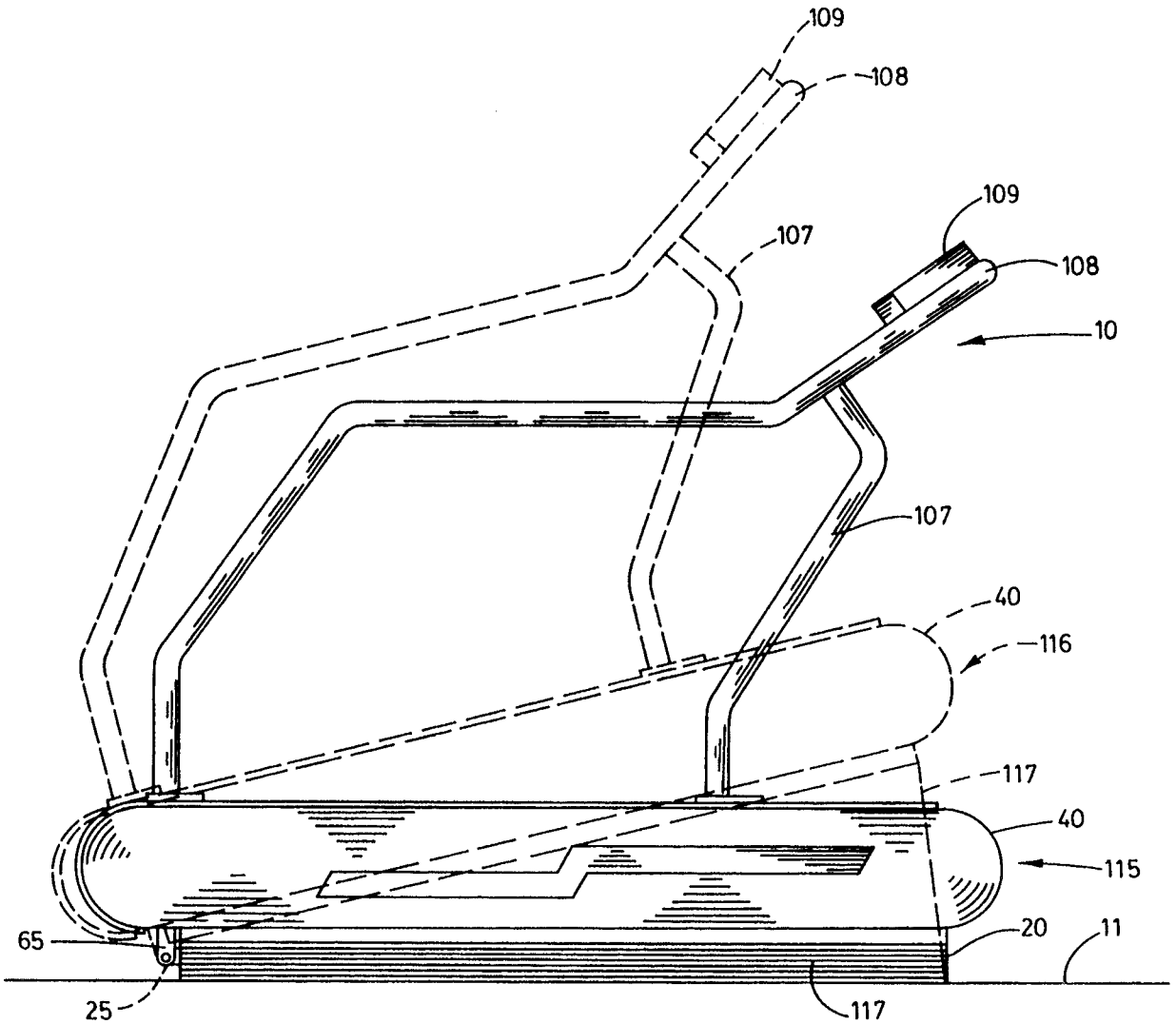
FIG. 2 is a side elevation of the apparatus of FIG. 1 shown in full lines in a lowered horizonal attitude and in phantom lines in an inclined attitude.

Referring more particularly to the drawings, the first embodiment of the apparatus of the present invention is generally indicated by the numeral 10 in FIG. 1. As shown in FIG. 2, the apparatus is rested on a supporting surface 11 which may be viewed, for illustrative convenience, as a concrete floor.

The apparatus 10 has a rigid base frame 20 composed of a plurality of transverse frame elements 21 each having a lower surface 22 and an opposite upper surface 23. The frame elements 21 are retained in spaced substantially parallel relation and are bounded by a peripheral plate 24 extending in rectangular relation entirely around the base frame 20 and secured, as by welding, on the frame elements to form the base frame. A pair of rear pivot mounts 25 are mounted on the rear frame element 21 visible in FIG. 1.

A treadmill frame or subframe 40 is mounted on the base frame 20. A subframe is composed of a plurality of cross plates 41 having opposite ends 42. A pair of lower channel members 43 are individually, weldably mounted on corresponding opposite ends 42 of the cross plates 41 so as to mount the lower channel members 43 in spaced, substantially parallel relation to each other and thereby forming the subframe. The channel members each have opposite ends 44 and a lower surface 45.

Figures 3, 4:
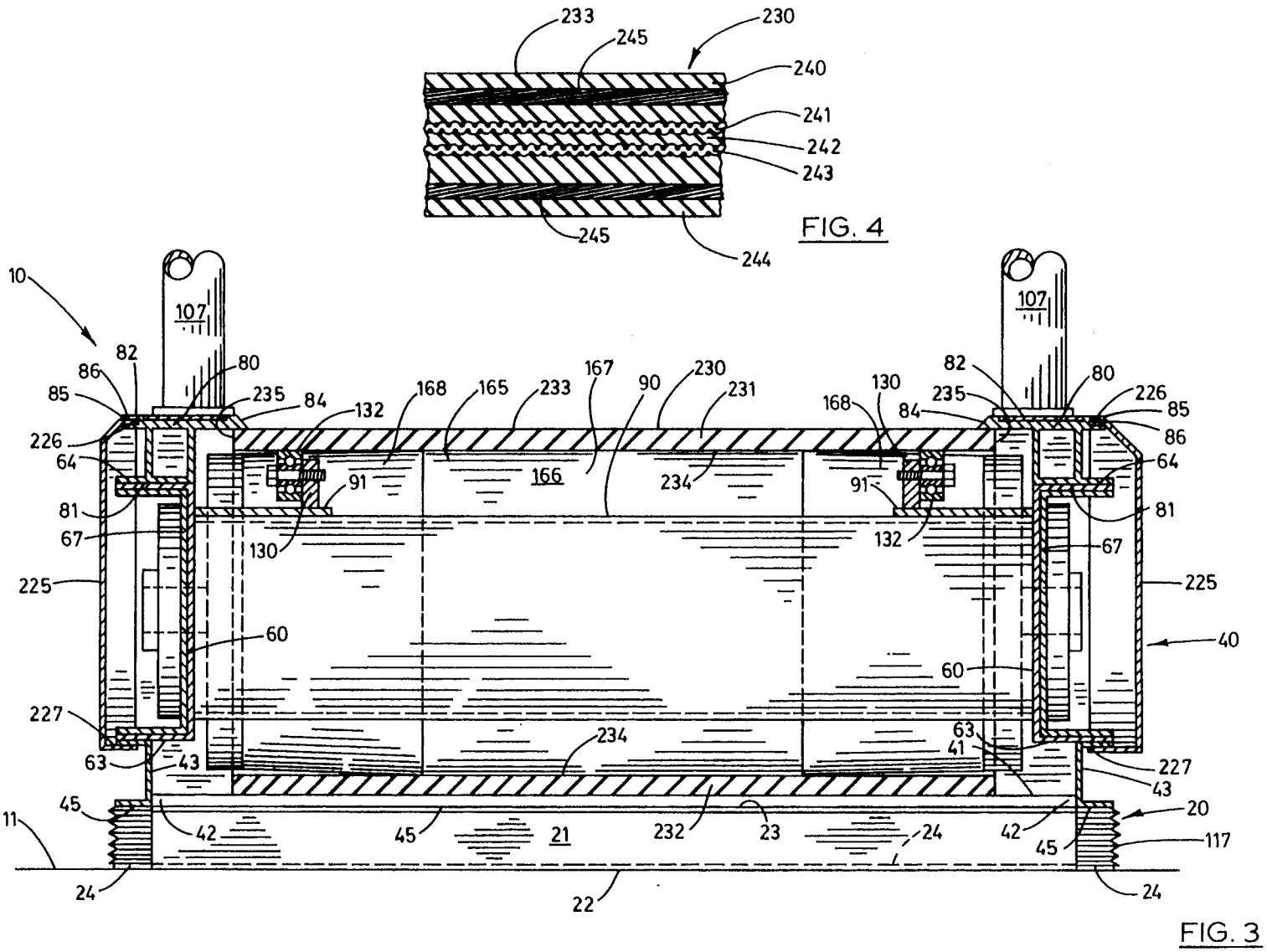
FIG. 3 is a somewhat enlarged, fragmentary, transverse, vertical section taken on line 3—3 in FIG. 1.
FIG. 4 is a somewhat further enlarged, fragmentary, transverse vertical section taken on line 4—4 in FIG. 1 showing the upper run of the conveyor belt.

The subframe 40 has a pair of main channel members 60 individually mounted on the lower channel members 43, as can best be seen in FIG. 3. The main channel members have front end portions 61 and rear end portions 62, as can best be seen in FIGS. 5 and 7. The main channel members have corresponding, substantially flat lower surfaces 63 which are disposed substantially in the same plane. The main channel members have upper surfaces 64. Pivot mounts 65 individually are mounted on and extend downwardly from the rear end portions 62 of the main channel members and are individually pivotally mounted on the rear pivot mounts 25 by pivot pins 66. Each of the main channel members defines a channel 67 facing outwardly from the subframe on a side thereof. The main channel members have corresponding, substantially circular openings 68 in the rear end portions 62 thereof, as can best be seen in FIGS. 5 and 7.

Tubular upper members 80 are individually mounted on the upper surfaces 64 of the main channel members. Each of the upper members has a substantially flat lower surface 81 and an opposite substantially flat upper surface 82. Each upper member has opposite ends 83. Each upper member has an inwardly projecting lip 84 extending toward the corresponding inwardly projecting lip of the other upper member. Each upper member has an outwardly projecting lip 85 facing in the opposite direction. Each outwardly projecting lip 85 has a slot 86 therein for purposes subsequently to be described.

The subframe 40 has a tubular cross beam 90 interconnecting the main channel members 60 adjacent to the corresponding front end portions 61 thereof. A pair of forward support plates are individually, weldably mounted on the main channel members 60 and on the tubular cross beam extending inwardly toward each other corresponding predetermined distances, as shown in FIG. 3. A central cross beam 92 is weldably mounted on and extends between the main channel members 60, as can best be seen in FIG. 5. A pair of upright supports are mounted by welding on the central cross beam in spaced relation to each other and, in turn, mount a central support plate 94 extending in spaced, substantially parallel relation to the forward support plates 91 and disposed in the same plane therewith. An upper rear cross beam 95 interconnects the main channel members 60 adjacent to the rear end portions 62 thereof. A lower rear cross beam 96 is mounted on and extends between the main channel members 60 and is mounted, in addition, on the upper rear cross beam 95.

The upper surfaces 82 of the upper members 80 individually mount suitable non-slip panels 105 which may be recessed therewithin as shown in FIGS. 1 and 3. Mounting plates 106 are mounted, as by bolts not shown, on the upper surfaces 82 of the upper members 80. Tubular side railings 107 are mounted on the mounting plates 106, as by welding, and are interconnected adjacent to and above the front end portions 61 of the main channel members by a cross beam 108. A suitable control housing 109 is mounted on the cross beam. The control housing 109 houses any desired controls and operational meters, gauges or the like.

Referring more particularly to FIG. 2, the subframe 40 is movable on the pivot mounts 65 between a lower or horizontal attitude or position 115, shown in full lines in FIG. 2, and a raised or inclined attitude or position 116, shown in phantom lines in FIG. 2. An accordion type flexible shroud 117 is secured on the lower surfaces 45 of the lower channel members 43 and the peripheral plate 24 of the base frame 20. The shroud is sufficiently flexible and expandable to expand as necessary during movement of the subframe 40 from the horizontal position 115 to the incline position 116 while keeping the area between the base frame and the subframe completely enclosed.

Figure 5:
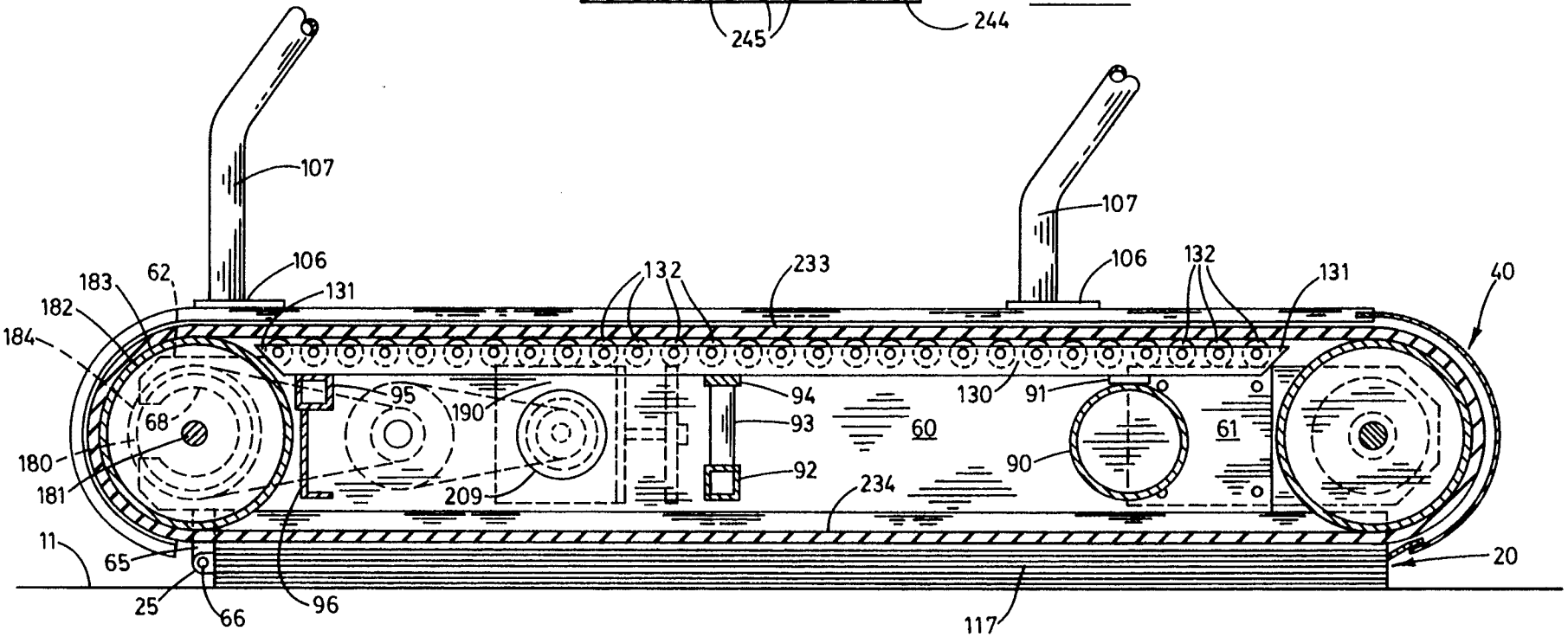
FIG. 5 is a somewhat enlarged, fragmentary, longitudinal, vertical section taken on line 5—5 in FIG. 1.

A pair of roller mounting bars 130 are individually, weldably mounted on the forward support plates 91, the central support plate 94 and the upper rear cross beam 95 in spaced substantially parallel relation as can best be visualized upon reference to FIGS. 3 and 5. Each roller mounting bar has opposite ends 131. A multiplicity of idler roller assemblies 132 are mounted on the roller mounting bars, as can best be seen in FIG. 3. The idler roller assemblies are of a conventional type each incorporating a bearing and rotational about an axis extending transversely of the apparatus. The idler roller assemblies 132 mounted on the roller mounting bars are mounted so as to define a substantially flat horizontal path of travel.

A pair of front roller mounting assemblies 140 individually mounted on the front end portions 61 of the main channel members 60. Each of the front roller mounting assemblies includes a mounting plate 141 having a bolt bracket 142 extending transversely thereof. A bolt hole 143 extends through the bolt bracket 142. Bearings 144 are individually mounted on the mounting plates 141 to define an axis of rotation extending transversely of the subframe 40 therebetween. Four bolt slots 145 extend through each mounting plate in corresponding positions and a rectangular slot 146 extends through each mounting plate between the pairs of bolt slots 145 thereof. Bolts 160 are individually screw-threadably secured in bolt holes, not shown, in the front end portions 61 of the main channel members aligned with the bolt slots 145. The bolts can be tightened down to lock their respective mounting plate in a selected position. A boss 161 is mounted on the front end portion of each channel member located in such a position as to extend outwardly through its respective rectangular slot 146. Each boss has an internal screw threaded bolt hole 162. An adjustment bolt 163 is extended through the bolt hole 143 of the bolt bracket 142 and screw-threadably secured and the internal screw threaded bolt hole 162 of the boss 161. Thus, it will be seen that by loosening the bolts 160 of each mounting plate 141 and rotating the adjustment bolt 163 thereof, each mounting plate can be adjusted outwardly from the front end portion 61 of its respective main channel member 60. The mounting plates are so adjusted in unison so as to position the bearings 144 of the mounting plates in the desired position, as will hereinafter be discussed in greater detail. In any case, when the desired position has been achieved, the bolts 160 are again tightened down to lock the mounting plates and thereby the bearings 144 in the selected position.

A front roller shaft 164 is rotationally received in and extends between the beatings 144 transversely of the subframe 40. A front roller 165 is mounted on the front roller shaft for rotational movement therewith. The front roller has an exterior surface 166 consisting of a cylindrical central portion 167 and tapered lateral portions 168, as can best be seen in FIG. 3.

Rear roller beatings 180 are mounted on the rear end portions 62 of the main channel members 60 aligned to define an axis of rotation extending transversely of the subframe 40. A rear roller shaft 181 is rotationally received in the rear roller bearings and extended therebetween in parallel relation to the front roller shaft 164. A rear roller 182 is mounted on the rear roller shaft 181 for rotational movement therewith. The rear roller has an exterior surface 183 which is cylindrical. A pulley 184 is mounted on the outer end of the rear roller shaft 181 for rotational movement therewith, as best shown in FIG. 7.

Figure 7:
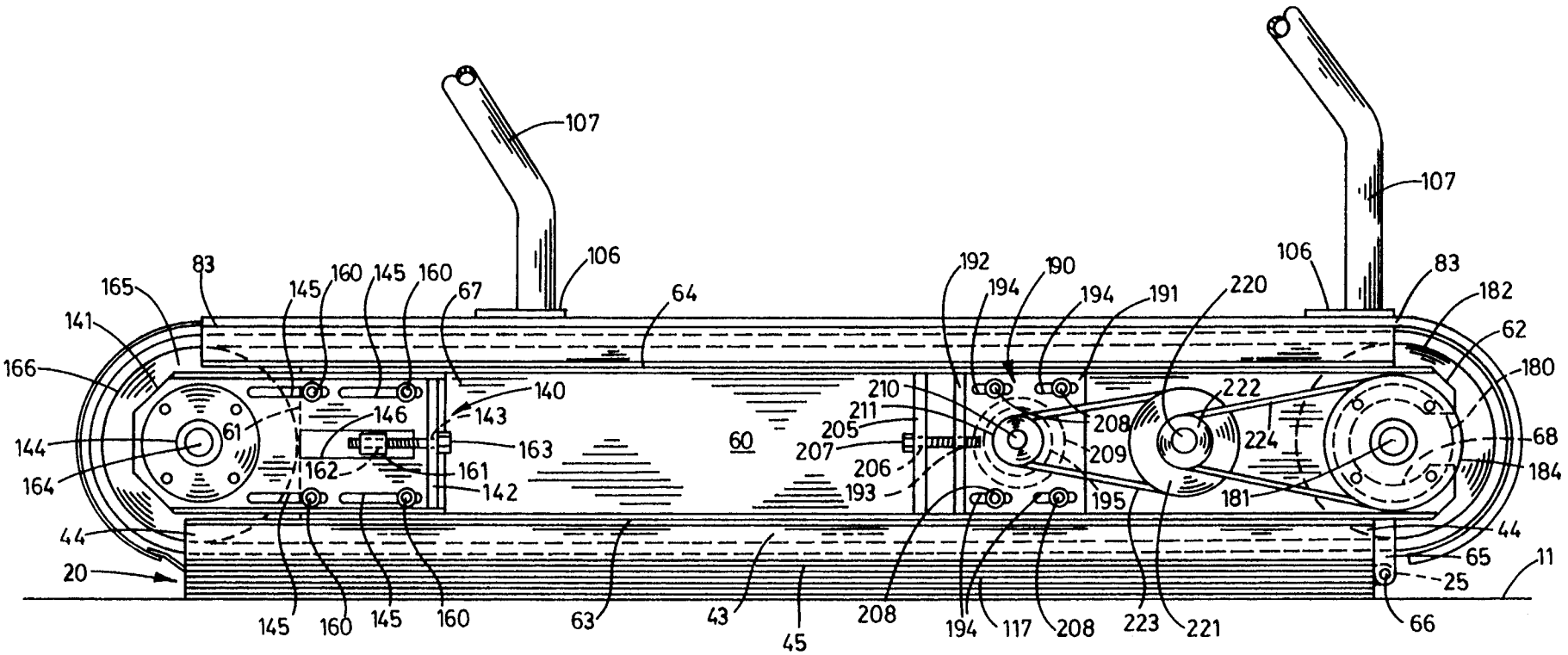
FIG. 7 is a somewhat enlarged, fragmentary, longitudinal, vertical section taken on line 7—7 in FIG. 1 showing the subsystems of the apparatus which are normally otherwise enclosed by a sheet metal housing.

A motor mounting assembly is generally indicated by the numeral 190 in FIG. 7. The motor mounting assembly includes a motor mounting plate 191 having a bolt bracket 192 which, in turn, has a screw threaded bore 193 extending therethrough is received within the channel 67 of the main channel member 60 on the left side of the apparatus when viewed in FIGS. 3 and 8 and as best shown in FIG. 7. Four bolt slots 194 extend through the motor mounting plate. A central opening 195 extends through the motor mounting plate.

A bolt bracket 205 is mounted on the same main channel member 60 visible in FIG. 7 within the channel 67 thereof. A bolt hole 206 extends through the bolt bracket and an adjustment bolt 207 is received therein. A plurality of bolts 208 are individually, screw-threadably received in screw threaded bolt holes, not shown, in the channel member. Thus, as with the mounting plates 141, the bolts 208 can be loosened and the adjustment bolt 207 adjusted to move the motor mounting plate 191 to the right or to the left as permitted by the bolt slots 194. Upon achieving the desired position, the bolts 208 can be tightened downwardly to lock the motor mounting plate in the selected position. A drive motor 209 is mounted on the motor mounting plate extending through the central opening 195 of the main channel member 60 and having a motor drive shaft 210 extending through the motor mounting plate in rotational relation. A pulley 211 is mounted on the terminal end of the motor drive shaft for rotational movement therewith.

A central pulley shaft 220 is mounted for rotational movement on the main channel member 60 substantially midway between the rear roller shaft 181 and the motor drive shaft 210. The central pulley shaft is also adjustable to the right or to the left, as viewed in FIG. 7, by means not shown. A large pulley 221 is mounted on the central pulley shaft for rotational movement therewith. A small pulley 222 is mounted on the central pulley shaft outwardly of the large pulley and similarly for rotational movement with the central pulley shaft. A first drive belt 233 is extended about the pulley 211 and the large pulley 221 so that the drive motor 209 is linked in driving relation to the large pulley 221 and thereby the central pulley shaft 220. A second drive belt 224 is extended about the small pulley 222 and the pulley 184 in driving relation thereto. Thus, through the linkage of the drive belts, the drive motor is connected in driving relation to the rear roller 182.

A pair of housings 225 are individually mounted on the opposite sides of the subframe 40. Each housing has an upper edge portion 226 received in its respective slot 86 of its respective upper member 80 and releasibly secured in position by screws, not shown. Each housing has a lower edge portion 227 which is secured, using screws, not shown, on its respective lower channel member 43.

Apparatus 10 has a conveyor belt 230 which is entrained about the front roller 165 and rear roller 182 for rotation thereabout as can best be visualized in FIGS. 3 and 5. The conveyor belt has an upper run 231 and a lower run 232. The upper run 231 has an upper load bearing surface 233. The upper run has a lower or inner surface 234 and extends to lateral edges 235. As can best be visualized in FIG. 3, the lateral edges 235 extend outwardly laterally of the idler roller assemblies 132 with the inner surface 234 of the upper run rested on the idler roller assemblies 132, as shown in FIG. 3.

Figure 6:
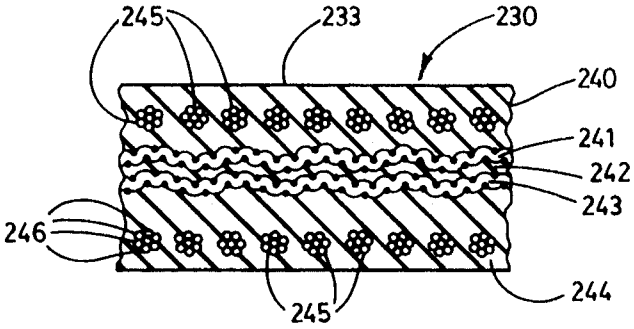
FIG. 6 is a somewhat further enlarged, fragmentary, longitudinal, vertical section taken on line 6—6 in FIG. 1 showing the upper run of the conveyor belt.

Referring more particularly to the internal construction of the conveyor belt 230, as shown in FIGS. 4 and 6, the conveyor belt has an upper rubber lamination 240, a fabric lamination 241 therebeneath, a central rubber lamination 242, a fabric lamination 243 and a lower rubber lamination 244. A multiplicity of structural elements 245 extend through both the upper rubber lamination and the lower rubber lamination in spaced substantially parallel relation extending transversely of the conveyor belt and vulcanized thereto. Each of the structural elements is composed of a bundle of steel wire strands 246 wound together as can best be visualized in FIGS. 4 and 6. Each structural element is thus, in effect, a steel cable. The structural elements in the respective upper and lower rubber laminations are disposed in planes parallel to the upper load bearing surface 233 of the conveyor belt. Thus, the structural elements defining the plane of the upper rubber lamination are substantially parallel to and vertically spaced from the structural elements defining the plane of the lower rubber lamination.

It has been found that the stiffness of the conveyor belt 230 can be varied by changing the spacing between the structural elements 245 defining the plane of the upper rubber lamination 240 and the structural elements defining the plane of the lower rubber lamination 244. The greater the distance between the planes of the structural elements of the upper and lower rubber laminations, the stiffer the conveyor belt, or, in other words, the more resistant the conveyor belt is to deformation.

This resistance to deformation can be calculated using moment of inertia formulas and the transfer formula for moment of inertia. For example, the formula $Ix=\bar{I}x+A(d/2)^2$ can be employed where "Ix" is the moment of inertia for the combination of the upper and lower structural elements, "$\bar{I}x$" is the moment of inertia for one structural element about its centroidal axis, "A" is the area of the cross section of the structural element and "d" is the distance between the upper and lower structural elements.

The hardness of the rubber employed in the laminations of the conveyor belt 230 also effects the stiffness of the conveyor belt. Both the hardness of the rubber and the spacing of the planes of the structural elements in the upper and lower rubber laminations 240 and 244 can be adjusted in combination to achieve the desired stiffness. The optimum stiffness for the conveyor belt is dependent upon the use to which the apparatus 10 is to be put. Thus, this ability to employ a conveyor belt of the precise desired stiffness offers the ability to meet virtually any training or therapeutic need.

SECOND EMBODIMENT

Figure 8:
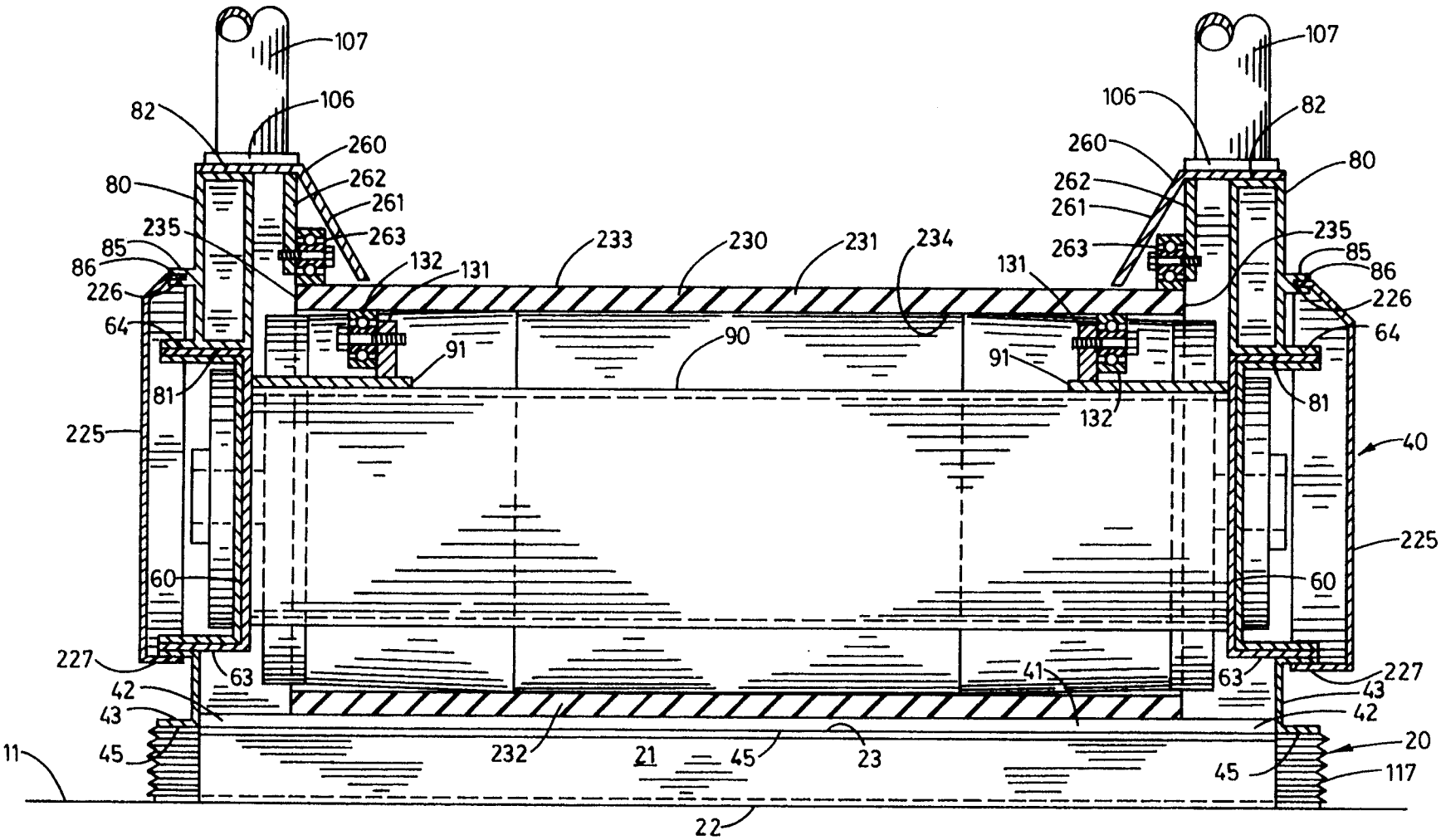
FIG. 8 is a somewhat enlarged, fragmentary, transverse, vertical section taken from a position indicated by line 3—3 in FIG. 1, but showing a second embodiment of the apparatus of the present invention.

A second embodiment of the apparatus 10 of the present invention is shown in FIG. 8. In all respects except as herein noted, the second embodiment of the apparatus of the present invention is identical to that heretofore described. The second embodiment of the invention varies from the first embodiment in that the upper members 80 of the subframe 40 are substantially greater height. Each upper member mounts an upper idler roller housing 260 which extends downwardly at an angle toward the upper run 231 of the conveyor belt, as shown in FIG. 8. The upper idler roller housings have sloped surfaces 261. Upper roller mounting bars 262 are mounted on and extend downwardly from the upper roller housings 260 and mount idler roller assemblies 263 at the terminal ends thereof in rolling engagement with the load bearing surface 233 of the conveyor belt 230 at the lateral edges 235 thereof.

It will be understood that there are substantially the same number of idler roller assemblies 263 as idler roller assemblies 132. Thus, it will be seen that the upper run 231 of the conveyor belt 230 is captured adjacent to its lateral edges 235 between the idler roller assemblies 132, in engagement with the inner surface 234 of the upper run 231 of the conveyor belt, and the upper idler roller assemblies 263, in engagement with the load bearing surface 233. For purposes hereinafter to be made more clearly apparent, the upper run 231 of the conveyor belt is thus supported in a substantially cantilever fashion extending between its lateral edges 235.

This construction in the second embodiment of the apparatus 10 permits, if desired, the upper run 231 of the conveyor belt 230 to be supported in such a fashion as to have a crown substantially centrally thereof. In other words, the load bearing surface 233 is higher in the center than at the lateral edges 235. This has benefit in some cases in physical therapy. Additionally, it permits greater weight to be borne by the load bearing surface, or, conversely, a thinner, less expensive conveyor belt to be employed.

OPERATION

The operation of the described embodiments of the subject invention is believed to be clearly apparent and is briefly summarized at this point. The apparatus is used in the described embodiments as a treadmill-type exercising apparatus.

The apparatus may also be constructed in embodiments for other purposes including for physical therapy. When used in the described embodiments, it is normally employed by a single user walking, running or otherwise moving on the load bearing surface 233 of the conveyor belt 230. When so used, the upper run 231 of the conveyor belt is transported from right to left as viewed in FIGS. 1, 2 and 5 at a velocity selected by the operator. The object is, of course, to move the upper run of the conveyor belt at a velocity such that the velocity of the user in a left to right direction, as viewed in those views, is substantially the same as the velocity of the upper run of the conveyor belt from fight to left as viewed therein. Where this is done, the user remains substantially in place on the load bearing surface of the conveyor belt while, for example, running on the surface. During such usage, the user can, if desired, grasp or otherwise use the side railings 107 and the cross beam 108 for support.

The velocity of the upper run 231 of the conveyor belt 230 is selected by the operator using controls, not shown, borne by the control housing 109. The controls are thus employed to activate and select the speed of the conveyor belt through a control system, not shown. The control system, thus, operates the drive motor 209 to drive the pulley 184 through the first and second drive belts 223 and 224. The pulley 184 drives the rear roller 182 in a clockwise direction, as viewed in FIG. 7, to move the upper run 231 of the conveyor belt 230 from left to right, as viewed in FIG. 7, or, in other words, in a clockwise direction as viewed therein. It will be understood that, as is conventionally the case, the operator can initiate and terminate the rotation of the conveyor belt and control its velocity from the control housing 109 so that such operation is completely within his control.

If desired, the subframe 40 of the apparatus 10 can be moved from the horizontal attitude 115, shown in full lines in FIG. 2, to the inclined attitude 116, shown in phantom lines in FIG. 2, or to any position therebetween for purposes of providing the exercising conditions desired. The shroud 117 expands and contracts to ensure that the internal structure of the apparatus remains concealed therewithin regardless of the position in which the subframe is positioned.

If desired, the tension on the conveyor belt 230 can be adjusted using the front roller mounting assemblies 140. As previously described, the bolts 160 can be loosened to permit the adjustment bolts 163 of the respective front roller mounting assemblies to be adjusted so as to move the mounting plates 141 in unison further to the left or further to the right, as viewed in FIG. 7, until the proper tension on the upper run 231 of the conveyor belt 230 is achieved. Thereafter, the bolts 160 can again be tightened down to lock the front roller 165 in the selected position. This is normally only required at the time of initial assembly, or if the conveyor belt 230 requires replacement or repair. Since one of the many benefits of the apparatus of the present invention is to avoid wear and damage to the conveyor belt, such repair or replacement of the conveyor belt may never be required.

As can be visualized upon reference to FIG. 4, once the conveyor belt 230 is in motion, the structural elements 245 in the upper run of the conveyor belt support the upper run 23 1 in a substantially horizontal attitude on the idler roller assemblies 132, as can be visualized in FIG. 3, relative to the first embodiment of the apparatus of the present invention. In the case of the second embodiment of the apparatus, shown in FIG. 8, the upper run of the conveyor belt is captured between the idler roller assemblies 132 engaging the inner surface 134 of the upper run 131 of the conveyor belt and the idler roller assemblies 263 engaging the load bearing surface 233 of the upper run. The upper run of the conveyor belt is, thus, retained in a substantially horizontal attitude by the substantially cantilever action achieved thereby between the idler roller assemblies on opposite sides adjacent to the lateral edges 235 of the conveyor belt. The structural elements 245 are sufficiently rigid that a person walking or running on the load bearing surface 233 is supported thereon with only slight downward flexing of the load bearing surface 233 in response to such motion. Conversely, the flexing permitted by the structural elements 245 operates to absorb the impact of the downward force in such walking or running on the load bearing surface 233 so that trauma to the body is reduced to a level not heretofore achievable in the art. This is because, in contrast, conventional treadmill-type exercising devices require a bed immediately underlying and supporting the inner surface of the upper run of the conveyor belt so that the belt cannot flex thereby causing trauma to the body of the user. Further, such impact in conventional devices increases the frictional resistance caused by engagement of the inner surface of the upper run of the conveyor belt with the bed thereby requiring a more powerful drive system, more energy to drive the drive system and substantial wearing of the conveyor belt and the other operable systems of such conventional treadmill-type exercising devices. As a consequence, the apparatus of the present invention in the first and second embodiments shown herein are able to operate through substantially prolonged operational lives, as compared with conventional devices, with smaller, less powerful drive systems, using less electrical energy and without the wearing and damage to operable systems thereof. This is achieved to a degree never before achieved in the art.

Therefore, the apparatus having a movable load bearing surface of the present invention has particular utility in use as a treadmill-type exercising apparatus wherein the belt employed can be rotated in its normal path of movement with minimum wearing or damage to the belt itself, the supporting structure therefore, the drive train operable to drive the belt and the other operative components of the apparatus all in an apparatus which imparts a cushioning effect ensuring that discomfort, trauma and injury are reduced to a minimum not heretofore achieved in the art.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. An apparatus having a movable load bearing surface, the apparatus comprising a frame having a first pair of laterally spaced conveying assemblies generally extending along a course of movement and mounting a plurality of rollers individually mounted for rotational movement about individual axes of rotation substantially transversely related to said course of movement; a conveying member, having lateral extremities and a lower surface, defining said load bearing surface supported on said conveying assemblies for movement substantially along said course of movement with said plurality of rollers inwardly of the lateral extremities of the conveying member and with the lower surface of the conveying member rested on said rollers and unsupported between the first pair of conveying assemblies; a multiplicity of structural elements mounted on said conveying member and extending substantially transversely to said course of movement and over said conveying assemblies to impart support to the load bearing surface; means for driving the conveying member over the conveying assemblies in said course of movement: and a second pair of conveying assemblies mounted on the frame in spaced, substantially parallel relation to each other and mounting a plurality of rollers individually mounted for rotational movement about individual axes of rotation substantially transversely related to said course of movement in engagement with said load bearing surface inwardly of the lateral extremities of the conveying member and outwardly of the rollers on which the lower surface of the conveying member is rested and with sufficient pressure against the load bearing surface in combination with said structural elements to impart substantially cantilever support to said load bearing surface.

2. An apparatus having a movable load bearing surface, the apparatus comprising a frame; a conveying member defining said load bearing surface and having lateral extremities; a multiplicity of structural elements borne by said conveying member extending substantially transversely between said lateral extremities thereof; two pair of conveying assemblies mounted on the frame engaging the conveying member on opposite sides thereof and individually adjacent to the lateral extremities of the conveying member with said structural elements to impart substantially cantilevered support to the conveying member for movement along a course of movement in the frame; and means for driving the conveying member through the conveying assemblies along said course of movement.

3. An exercising apparatus of the treadmill type on which a person can run substantially in place, the exercising apparatus comprising a frame defining an axis of reference extending therethrough in a predetermined direction; a pair of conveying assemblies mounted on the frame, each conveying assembly including a plurality of rollers individually mounted for rotational movement about individual, substantially parallel axes of rotation defining substantially a common plane and individually disposed in substantially right angular relation to said axis of reference of the frame and the rollers of the respective conveying assemblies spaced from each other on opposite sides of the axis of reference; a pair of conveyor belt support assemblies mounted on the frame with the pair of conveying assemblies extending therebetween, each of the support assemblies rotational about an axis of rotation substantially right-angularly related to said axis of reference of the frame; a conveyor belt having lateral extremities entrained about said support assemblies and having an upper run rested on and extending between the rollers of the respective conveying assemblies for movement along a course substantially parallel to said axis of reference of the frame; a multiplicity of substantially rigid structural elements capable of limited flexing under load encapsulated within the conveyor belt in spaced relation and extending between said lateral extremities of the conveyor belt to impart support to said upper run rested on the rollers of the respective conveying assemblies while possessing an impact absorbing character; and means for driving the conveyor belt about the conveyor belt support assemblies to transport the upper run of the conveyor belt over the rollers of the respective conveying assemblies in a direction opposite to said predetermined direction at a velocity such that a person facing in said predetermined direction can run substantially in place on the upper run of the conveyor belt with the impact thereof substantially absorbed by said upper run and the substantially rigid structural elements encapsulated therewithin.

4. The exercising apparatus of claim 3 wherein the multiplicity of structural elements are disposed in substantially parallel relation to each other within the conveyor belt, are substantially right-angularly related to said axis of reference of the frame and extend over said rollers of the respective conveying assemblies.

5. The exercising apparatus of 4 wherein said structural elements are encapsulated in said conveyor belt substantially in a pair of planes substantially parallel to each other.

6. The exercising apparatus of claim 3 wherein the upper run of the conveyor belt has a lower surface which is unsupported between said conveying assemblies except by said upper run itself and the structural elements encapsulated therewithin whereby the resistance imparted to said upper run during movement of the upper run in said direction opposite to said predetermined direction is minimized.

* * * * *

UNITED STATES PATENT AND TRADEMARK OFFICE

CERTIFICATE OF CORRECTION

PATENT NO. : 5,336,145

DATED : August 9, 1994

INVENTOR(S) : Dennis L. Keiser

It is certified that error appears in the above-identified patent and that said Letters Patent is hereby corrected as shown below:

Column 2, Line 6, delete "produced" and substitute ---produce---;

Column 5, Line 56, delete "beatings" and substitute ---bearings---;

Column 5, Line 62, delete "beatings" and substitute ---bearings---;

Column 6, Line 46, delete "233" and substitute ---223---; and

Column 10, Line 47, delete ":" and substitute ---;---.

Signed and Sealed this

Eleventh Day of October, 1994

*Attest:*

*Attesting Officer*

Bruce Lehman

BRUCE LEHMAN

*Commissioner of Patents and Trademarks*